US008707724B2

(12) United States Patent
Kim et al.

(10) Patent No.: US 8,707,724 B2
(45) Date of Patent: Apr. 29, 2014

(54) REFRIGERATOR WITH ICE MAKING ROOM

(75) Inventors: Dong-Jeong Kim, Seoul (KR); Chang-Ho Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 920 days.

(21) Appl. No.: 12/547,589

(22) Filed: Aug. 26, 2009

(65) Prior Publication Data

US 2010/0147009 A1 Jun. 17, 2010

(30) Foreign Application Priority Data

Dec. 11, 2008 (KR) ..... 10-2008-0126047

(51) Int. Cl.
*F25C 1/22* (2006.01)
*F25C 1/00* (2006.01)

(52) U.S. Cl.
CPC ..... *F25C 1/00* (2013.01)
USPC ..... 62/340; 62/353

(58) Field of Classification Search
CPC ..... F25C 1/00
USPC ..... 62/337, 344, 340, 353, 377, 407, 420, 62/425, 441, 449; 454/195, 201, 211–227, 454/247, 245, 306–310, 368–369; 296/29, 296/207–209
See application file for complete search history.

(56) References Cited

U.S. PATENT DOCUMENTS 3,596,936 A * 8/1971 Dieckmann et al. ..... 285/222.1
6,273,145 B1 * 8/2001 Botting ..... 138/166
2005/0183441 A1 * 8/2005 Lee et al. ..... 62/340
2005/0210909 A1 * 9/2005 Kim et al. ..... 62/340
2005/0252232 A1 11/2005 Lee et al.
2006/0096310 A1 * 5/2006 Lee ..... 62/348
2007/0074527 A1 * 4/2007 Lee et al. ..... 62/344
2007/0209382 A1 * 9/2007 Kim et al. ..... 62/340

FOREIGN PATENT DOCUMENTS

JP 06-011228 1/1994
KR 10-2005-0077557 8/2005
KR 10-2006-0088143 8/2006

OTHER PUBLICATIONS

International Search Report and Written Opinion issued in PCT/KR2009/003649 dated Feb. 25, 2010.

* cited by examiner

*Primary Examiner* — Frantz Jules
*Assistant Examiner* — Emmanuel Duke
(74) *Attorney, Agent, or Firm* — KED & Associates, LLP

(57) ABSTRACT

A refrigerator with an ice making chamber is provided. The refrigerator may include a main body that defines a cooling chamber, and lateral wall passages formed at a lateral wall of the cooling chamber. A door that is rotatably coupled to the cooling chamber may be provided with an ice making chamber installed on an interior side thereof, and a connection duct part that connects the ice making chamber to the lateral wall passages. The connection duct part may include passage forming members that define a cold air passage therein, and insulation portion formed around the passage forming members, whereby components of the duct may be quickly and easily assembled at correct positions.

12 Claims, 6 Drawing Sheets

REFRIGERATOR WITH ICE MAKING ROOM

CROSS-REFERENCE TO RELATED APPLICATIONS

This disclosure claims priority to Korean Application No. 10-2008-0126047, filed in Korea on Dec. 11, 2008, the entirety of which is incorporated herein by reference.

BACKGROUND

1. Field

A refrigerator having an ice making room is provided.

2. Background

A refrigerator is an appliance for freshly storing food items in a cooled or frozen state. Such a refrigerator may include a main body having a cooling chamber formed therein, doors coupled to the main body for opening and closing the cooling chamber, and a refrigeration cycle device for supplying cold air into the cooling chamber. The refrigerating cycle device may include, for example, a compressor for compressing a refrigerant, a condenser for condensing the refrigerant, an expander for decompressing and expanding the refrigerant, and an evaporator in which the refrigerant absorbs latent heat to be evaporated. Refrigerators may include various functions and features that enhance user convenience and consumer satisfaction, such as, for example, an ice making system for making ice, and an ice bank located below the ice maker for storing the ice made by the ice maker for later consumption by the user. Flexibility in the placement of such an ice maker and ice making chamber would further enhance user convenience and consumer satisfaction.

BRIEF DESCRIPTION OF THE DRAWINGS

The embodiments will be described in detail with reference to the following drawings in which like reference numerals refer to like elements wherein.

DETAILED DESCRIPTION

Some refrigerators may be implemented as bottom freezer type refrigerators, having a refrigerating chamber formed at an upper portion of the refrigerator main body and a freezing chamber formed at a lower portion thereof. Such a bottom freezer type refrigerator may include a dispenser provided at a front surface of a refrigerating chamber door to dispense ice and water.

The refrigerating chamber door may be provided with an ice making chamber for storing ice to be dispensed via the dispenser. To this end, a cold air duct for supplying cold air from the freezing chamber into the ice making chamber may be formed at the lateral wall of the refrigerator main body, and a connection duct may be provided at a side of the ice making chamber to connect the lateral wall cold air duct and the ice making chamber.

The connection duct may be formed of expandable polystyrene (EPS) resin (hereinafter, referred to as 'EPS') such that a cold air passage may be formed therein. The connection duct may be positioned between a door outer plate and a door inner plate (liner) before the refrigerating chamber door is filled with foam.

However, the EPS can have a relatively high coefficient of thermal conduction, thus increasing the size (or thickness) of the connection duct required in order to ensure adequate insulation, negatively impacting the size of the ice making chamber. Further, due to the properties of the EPS, the connection duct cannot be easily aligned with peripheral components, and a separate fixing member is required to fix the connection duct to the ice making chamber, making the assembly process time and labor intensive.

Figure 1:
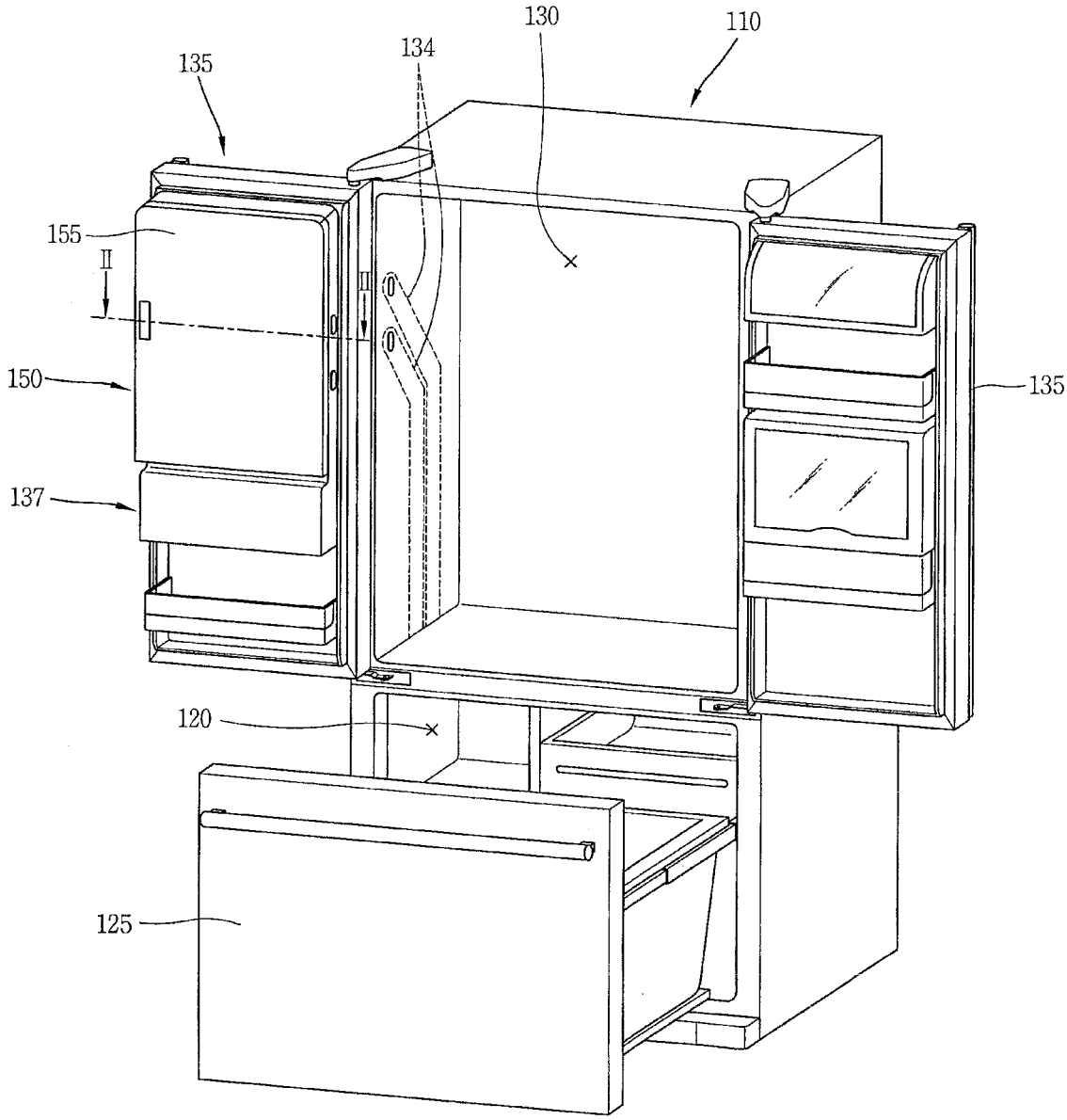
FIG. 1 is a perspective view of a refrigerator with an ice making chamber in accordance with an embodiment as broadly described herein.

As shown in FIG. 1, a refrigerator with an ice making chamber as embodied and broadly described herein may include a refrigerator main body 110 that defines a cooling chamber having a freezing chamber 120 and a refrigerating chamber 130 formed therein. Lateral wall passages 134 may be formed at a lateral wall of the refrigerating chamber 130. Doors 135 that open/close the refrigerating chamber 130 may have an ice making chamber 150 mounted thereto, with at least one connection duct part 180 disposed at one side of the ice making chamber 150 for connecting the ice making chamber 150 to the lateral wall passages 134. The freezing chamber 120 may be provided with a freezing chamber door 125 that slidably opens and closes the freezing chamber 120.

Figure 5:
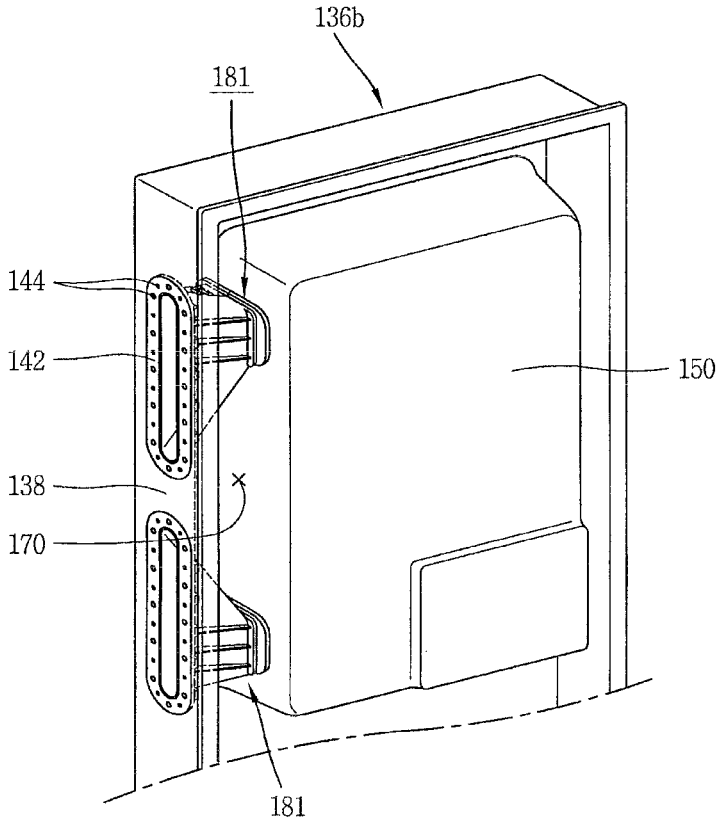
FIG. 5 is a perspective view of a coupled state between an inner plate of the refrigerating chamber door and the passage forming member shown in FIG. 2.
Figure 6:
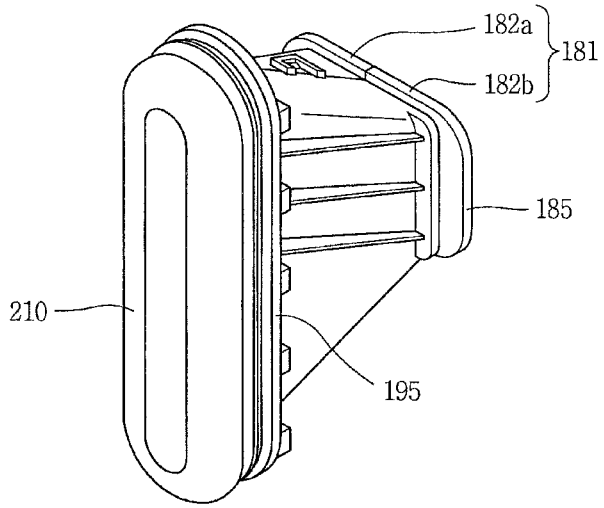
FIG. 6 is a perspective view of a coupled state between the passage forming member shown in FIG. 2 and a gasket.

A dispenser 137 through which water or ice is dispensed may be provided in one of the refrigerating chamber doors 135 with the ice making chamber 150. In the exemplary embodiment shown in FIGS. 1, 3 and 5, the dispenser 137 and the ice making chamber 150 are provided in the left refrigerating chamber door 135. Other locations may also be appropriate.

The lateral wall passages 134 may supply cold air from the freezing chamber 120 into the ice making chamber 150. In certain embodiments, the lateral wall passages 134 may be formed as a pair, with one of the lateral wall passages 134 configured as a cold air supplying passage through which cold air from the freezing chamber 120 is supplied into the ice making chamber 150, and the other of the lateral wall passages 134 configured as a cold air returning passage through which air that has passed through the ice making chamber 150 flows back into the freezing chamber 120.

Figure 2:
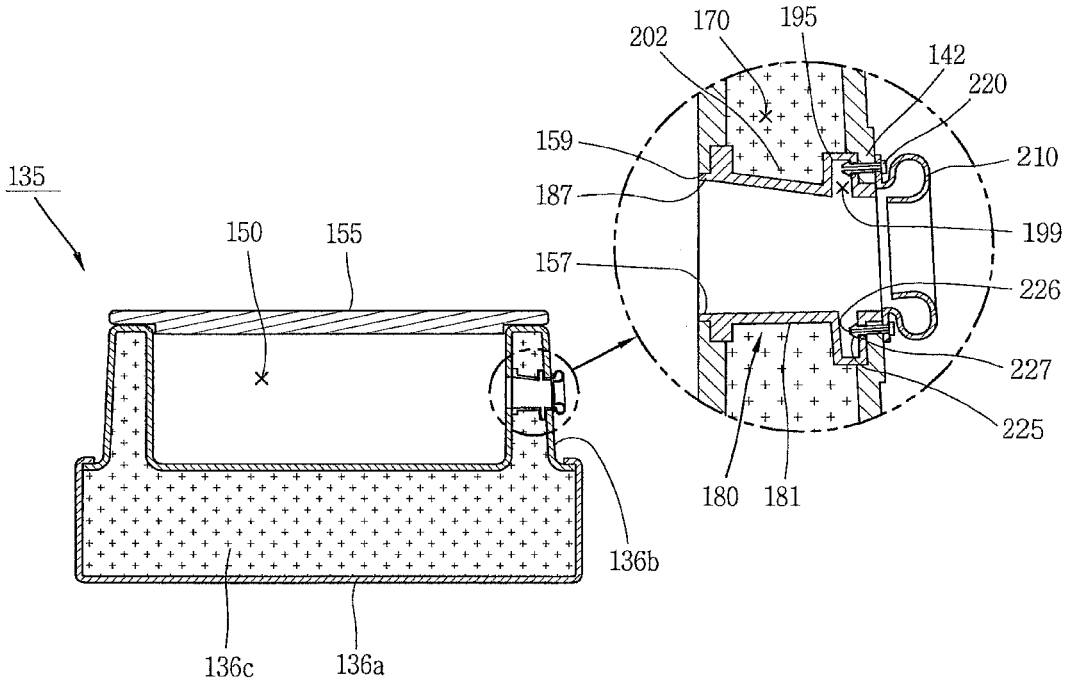
FIG. 2 is a cross-sectional view of a refrigerating chamber door taken along the line II-II of FIG. 1.

As shown in FIG. 2, the refrigerating chamber door 135 may include a door outer plate **136*a* that forms an outer appearance of the door 135, a door inner plate (liner) 136*b* coupled to an interior side of the door outer plate 136*a*, and a foaming agent 136*c* filled in a space formed between the outer and inner plates 135*a* and 135*b***.

The ice making chamber 150 may be positioned at an upper portion of the refrigerating chamber door 135, and more particularly, at the door inner plate **136*b***. The door outer plate 136*a* may be formed of a metal, and the door inner plate 136*b* may be formed of a synthetic resin, such as, for example, an acrylonitrile butadiene styrene (ABS) resin.

The ice making chamber 150 may be provided with an ice making chamber door 155 for opening and closing the ice making chamber 150. An ice maker (not shown) may be disposed within the ice making chamber 150. A side of the ice making chamber 150 may be spaced apart from a corresponding lateral wall 138 of the door inner plate 136*b*, and more particularly, from the lateral wall 138 at the side of door 135 adjacent to the lateral wall passages 134 so that a space 170 or gap may be formed between the lateral wall 138 and a corresponding side of the ice making chamber 150.

A pair of coupling holes 157 may be formed in a lateral side of the ice making chamber 150 facing the space. Communication holes 139 may be formed in the lateral wall 138 of the door inner plate 136*b* in communication with the space 170. A coupling portion 142 may extend along the circumference of each communication hole 139.

A connection duct part 180 that connects the lateral wall passages 134 of the refrigerator main body 110 to the ice making chamber 150 may be positioned in the space 170. The connection duct part 180 may include passage forming members 181 that form a cold air passage, and insulation portions 202 at the circumference of the passage forming members 181. In certain embodiments, the passage forming member 181 may be formed of a synthetic resin with a certain amount of rigidity, such as, for example, ABS resin, to be relatively thin.

The insulation portion 202 may be a foaming agent 136*c* (polyurethane) filled between the door outer plate 136*a* and the door inner plate 136*b*, allowing the insulation thickness of the connection duct part 180 to be reduced, and increasing the size of the ice making chamber 150. Alternatively, the size of the ice making chamber 150 may be maintained, and an internal storage space of the refrigerating chamber 130 may be increased.

Figure 3:
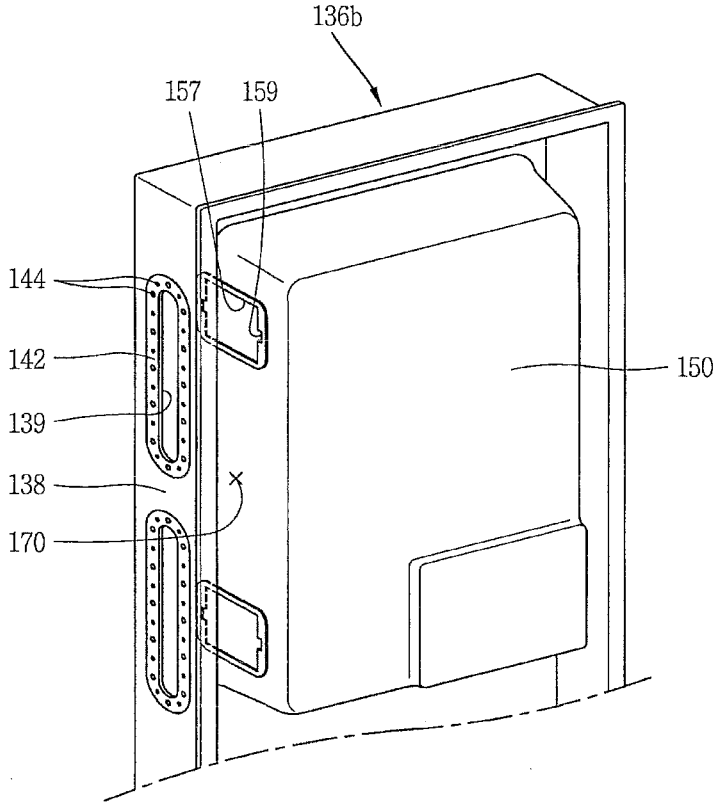
FIG. 3 is a perspective view of an ice making chamber before the coupling of a passage forming member shown in FIG. 2.

As shown in FIG. 3, the coupling holes 157 are formed at one side surface of the ice making chamber 150, with the passage forming members 181 positioned therein. As shown in FIG. 3, two coupling holes 157 may be provided longitudinally spaced apart from each other at the side of the ice making chamber 15. Accordingly, cold air can be introduced into the ice making chamber 150 through one of the coupling holes 157, and air may be discharged out of the ice making chamber 150 through the other. Each of the coupling holes 157 may have protrusion grooves 159 in which protrusions 187 of the passage forming members 181 may be inserted.

Figure 4:
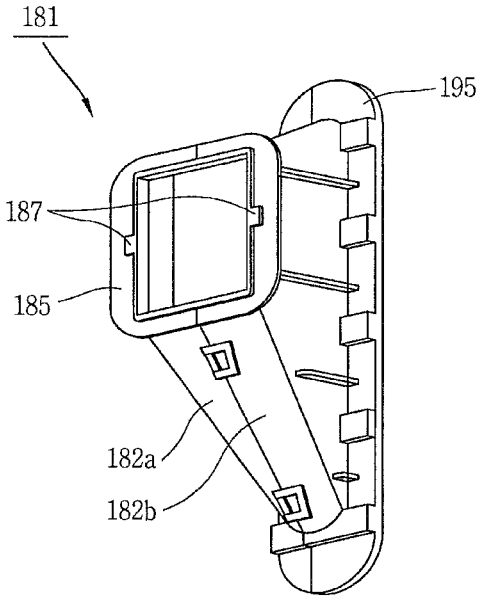
FIG. 4 is a perspective view of the passage forming member shown in FIG. 2.

Each of the passage forming members 181, as shown in FIG. 4, may include a first partial passage forming member 182*a* and a second partial passage forming member 182*b* positioned immediately adjacent to each other so as to form a single cold air passage. In the embodiment shown in FIG. 4, the first and second partial passage forming members 182*a* and 182*b* are vertically arranged, adjacent to each other. Other arrangements may also be appropriate.

A first end portion 185 of each passage forming member 181 may be substantially square, and a second end portion 195 may have a substantially rectangular or oval shape with a relatively long length. The first end portion 185 is coupled to the coupling hole 157 of the ice making chamber 150, and the second end portion 195 is coupled to the communication hole 139 formed at the outer wall of the door inner plate 136*b*.

Protrusions 187 that protrude from the first end portion 185 of the passage forming member 181 may be inserted into protrusion grooves 159 formed at each coupling hole 157. Accordingly, the protrusions 187 and grooves 159 allow the first end portion 185 of the passage forming member 181 to be quickly and easily coupled to the coupling hole 157 at a correct position.

Figure 7:
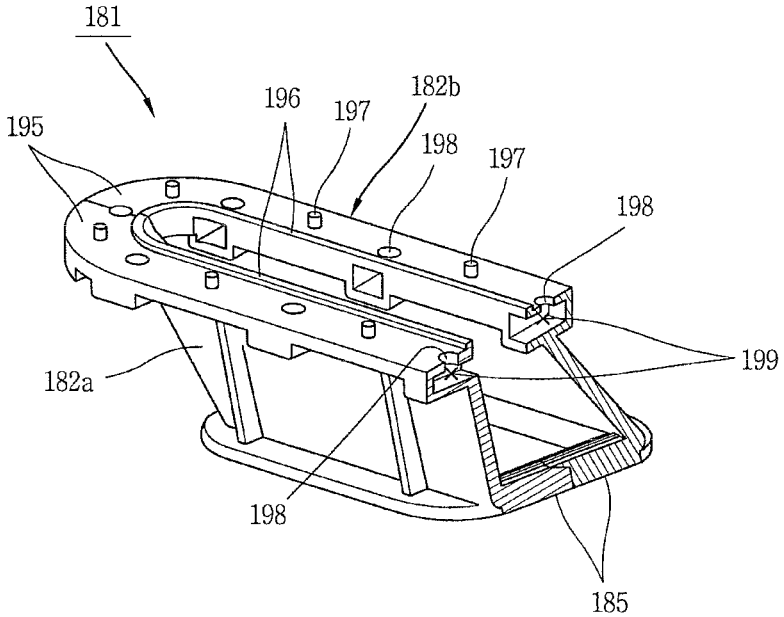
FIG. 7 is a partially cut-away perspective view of a passage forming member shown in FIG. 4.
Figure 8:
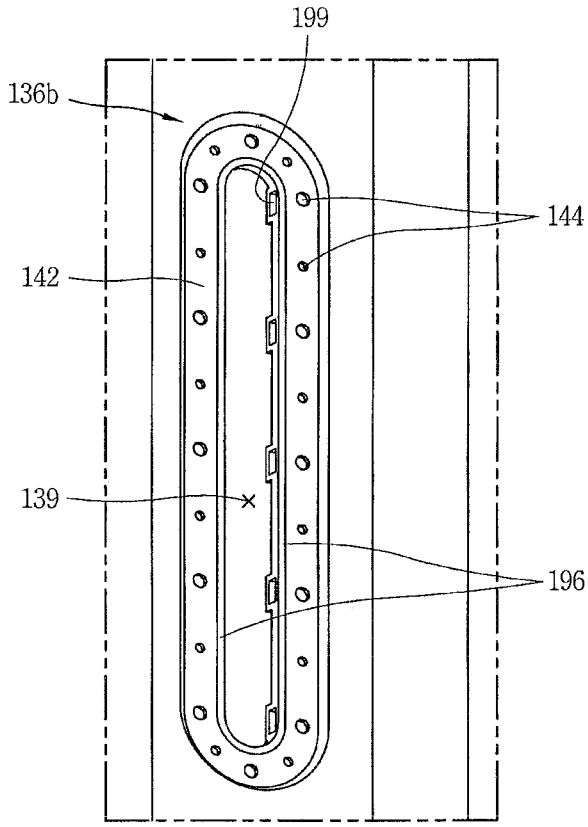
FIG. 8 is a perspective view of a second end portion the passage forming member shown in FIG. 3 before the gasket is coupled thereto.

As shown in FIGS. 6 to 10, a jaw portion 196 may be formed at a central section of the second end portion 195 of the passage forming member 181 so as to be outwardly exposed via the communication hole 139. The second end portion 195 may be coupled to the communication hole 139 such that it contacts an internal circumferential surface of the communication hole 139. In this embodiment, the second end portion 195 is inserted in the coupling portion 142 to a certain depth so that corresponding surfaces of the second end portion 195 and the coupling portion 142 contact each other. A plurality of protrusions 197 may protrude from a plate surface at the second end portion 195. Protrusion accommodating portions 198 may also be formed at the second end portion 195, each having an extension portion 199 as shown in FIGS. 7 and 8.

Figure 10:
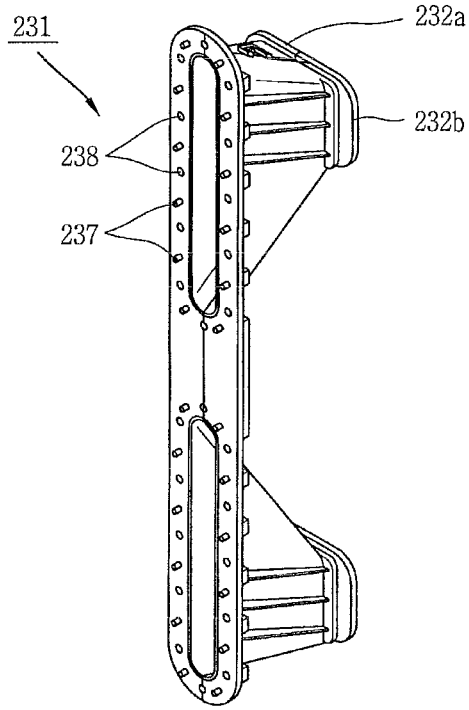
FIG. 10 is an exemplary variation of the passage forming member shown in FIG. 4.

In the alternative embodiment shown in FIG. 10, a pair of passage forming members 231 may include a first partial passage forming member 232*a* positioned immediately adjacent to a second partial passage forming member 232*b* so as to form two cold air passages. A plurality of protrusions 237 and a plurality of protrusion accommodating portions 238 may be formed along both end portions of the passage forming member 231.

As shown in FIG. 8, the coupling portion 142 may extend around each communication hole 139 formed at the side wall 138 of the door inner plate 136*b* such that the second end portion 195 of the passage forming member 181 can be inserted therein. The coupling portion 142 may include a plurality of through holes 144 corresponding to the protrusions 197 and the protrusion accommodating portions 198 of the passage forming member 181. Accordingly, the second end portion 195 of the passage forming member 181 may be quickly and easily coupled to the coupling portion 142 at a correct position. Also, this coupling structure may be sufficiently strong and rigid so as to tolerate a foam filling operation without a separate supporting member.

Figure 9:
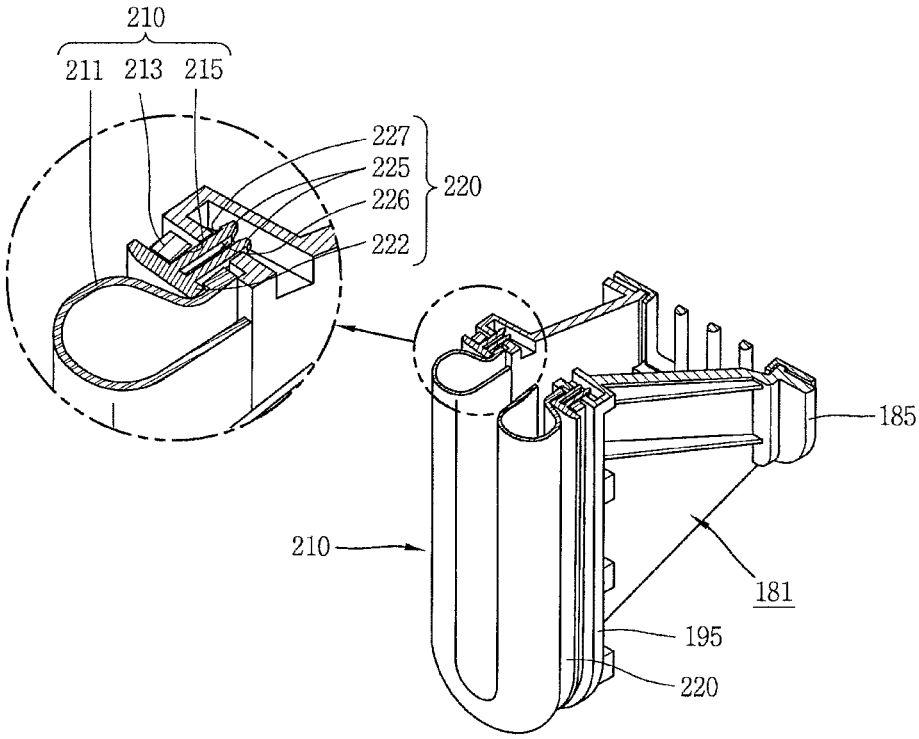
FIG. 9 is a partially cut-away perspective view of the coupled state between the passage forming member and the gasket shown in FIG. 6.

As shown in FIG. 9, a gasket 210 may be coupled to the external side of the second end portion 195 of each passage forming member 181. The gasket 210 contacts an inlet into the lateral wall passage 134 formed at the inner wall of the refrigerating chamber 130 when the refrigerating chamber door 135 is closed, so as to prevent the leakage of cold air. The gasket 210 may be formed of, for example, rubber, and may be configured in an oval shape to correspond to the shapes of the second end portion 195 of the passage forming member 181 and the coupling portion 142. The gasket 210 may include a deformable body 211 having tube shaped a section, and a flange 213 formed at one side of the body 211 so as to contact the coupling portion 142. A plurality of through holes 215 may be formed at the flange 213 to correspond to the protrusions 197 and the protrusion accommodating portions 198 of the second end portion 195 of the passage forming member 181.

A coupling member 220 may be provided at an outside of the flange 213, with one portion of the coupling member 220 inserted through the flange 213 and the coupling portion 142. The coupling member 220, as shown in FIG. 9, may include a plate portion 222 contacting the flange 213, and protrusions or hooks 225 that protrude from a side of the plate portion 222 to be inserted in the protrusion accommodating portions 198 of the passage forming member 181.

The protrusions of the coupling member 220 may be configured in the form of hooks 225 that are elastically transformed in a direction that they are inserted, with a cut portion 226 formed between the hooks 225. Accordingly, the hooks 225 can be contracted upon being inserted through the through holes 215 in the flange 213 and the through holes 144 in the coupling portion 142 and be expanded by their own elastic forces after being inserted in the protrusion accommodating portions 198. The hooks 225 may include a stopper 227 that is accommodated in the expansion portion 199 of the protrusion accommodating portion 198, such that the stopper 227 is engaged within the expanding portion 199 of the protrusion accommodating portion 198, thereby preventing the separation of the hooks 225.

Thus, when so configured, before filling foam in the refrigerating chamber door 135, each passage forming member 181 is positioned within the space 170 formed between the door inner plate 136*b* and the ice making chamber 150. That is, the first end portion 185 of each passage forming member 181 is coupled to a respective coupling hole 157 of the ice making chamber 150, and the second end portion 195 is coupled to a respective coupling portion 142. The protrusions 187 and 197 respectively formed at the first and second end portions 185 and 195 of each passage forming member 181 allow a fast and easy coupling of the corresponding passage forming portions 181 at a correct position. In addition, sufficient strength and rigidity to tolerate the pressure of the foaming operation is provided.

After the coupling of each of the passage forming members 181, the gasket 210 is positioned outside the door inner plate 136*b* in contact with the coupling portion 142, and the coupling member 220 is coupled to the gasket 210.

Next, the door outer plate 136*a* is positioned outside the door inner plate 136*b*, and a foaming agent 136*c* (polyurethane) is injected between the door inner plate 136*b* and the door outer plate 136*a* so that the insulation portion 202 is formed around each passage forming member 181 by the foaming agent 136*c*.

The foaming agent 136*c*, namely, the insulation portion 202 formed of polyurethane, has a very low coefficient of thermal conduction, so as to more effectively prevent the loss of cold air, allowing an increase in the size of the ice making chamber 150 or the storage space formed within the refrigerating chamber 130.

As described above, in accordance with one embodiment as broadly described herein, a synthetic resin having rigidity, such as ABS resin, may be used to form passage forming members such that a cold air passage may be formed therein. After the passage forming members are coupled to a door inner plate, a foaming operation may be executed to form insulation portions around the passage forming members by using polyurethane, whereby an insulation thickness of a connection duct part can be reduced, thereby increasing the size of an ice making chamber. Alternatively, if it is not intended to increase the size of the ice making chamber, a size of an internal storage space of a refrigerating chamber may be increased. That is, the insulation portion is formed of the polyurethane having a remarkably low coefficient of thermal conduction as compared to EPS, thus reducing the loss of cold air and also drastically decreasing a deviation in temperature at an outer surface of the connection duct part, resulting in reducing an insulation thickness of the connection duct part.

In addition, the passage forming member formed of the ABS resin may be coupled to its peripheral components at a correct position due to the property of the material, so as to be quickly and easily assembled.

Furthermore, the passage forming member may be provided with protrusions so as to be quickly and easily coupled to the peripheral components at the correct position and to sufficiently ensure a coupling rigidity. Accordingly, a separate component for fixing the connection duct is not separately required.

Hence, fabrication time and fabrication cost can be reduced.

A refrigerator with an ice making chamber capable of allowing the fast and easy assembly of components of a duct at accurate positions is provided.

A refrigerator with an ice making chamber capable of reducing the number of components of the duct and an insulation thickness is provided.

A refrigerator as embodied and broadly described herein may include an ice making chamber, including a refrigerator main body provided with a cooling chamber and lateral wall passages formed at a lateral wall of the cooling chamber; and a door provided with an ice making chamber and a connection duct part for connecting the ice making chamber to the lateral wall passages and configured to open and close the cooling chamber, wherein the connection duct part includes passage forming members configuring a cold air passage therein, and insulation portions formed around the passage forming members.

The passage forming member may be formed of a synthetic resin.

The passage forming member may be formed of an acrylonitrile butadiene styrene (ABS) resin.

The passage forming member and the insulation portion may be formed of different materials from each other.

The ice making chamber may be configured to be spaced apart from one lateral wall of an inner plate of the door by a preset distance, and the connection duct part may be disposed between the one lateral wall of the inner plate and the ice making chamber.

The door may be rotatably coupled to the refrigerator main body, and the connection duct part may be disposed at a lateral wall at the side of a hinge of the door.

The passage forming member may be coupled to the lateral wall of the inner plate, having an exposal end portion partially exposed to the exterior.

The connection duct part may further include a gasket coupled to the exposal end portion of each passage forming member.

One of contact surfaces between the passage forming member and the gasket may be provided with protrusions, and another contact surface may be provided with protrusion accommodating portions in which the protrusions are accommodated.

The passage forming member and the gasket may be provided with both protrusions and protrusion accommodating portions, respectively.

The connection duct part may further include a coupling member disposed outside each gasket and configured to fix the corresponding gasket.

The coupling member may be provided with protrusions inserted through the gasket to be coupled to the passage forming member.

The protrusion may be configured as a hook.

The insulation portion may be formed by a foaming operation.

A refrigerator with an ice making chamber in accordance with another embodiment as broadly described herein may include a refrigerator main body provided with a cooling chamber and lateral wall passages formed at a lateral wall of the cooling chamber; and a door provided with an ice making chamber and configured to open and close the cooling chamber, wherein the door includes a door outer plate, a door inner plate having the ice making chamber and disposed in the door outer plate to be spaced apart therefrom, and a connection duct part provided with passage forming members formed at one side of the ice making chamber to be connectable to the lateral wall passages and configuring a cold air passage therein, and insulation portions formed around the passage forming members and formed of a different material from the passage forming member.

The passage forming member may be formed of a synthetic resin.

The insulation portion may be formed by a foaming operation.

A refrigerator with an ice making chamber in accordance with another embodiment as broadly described herein may include a refrigerator main body provided with a cooling chamber and lateral wall passages formed at a lateral wall of the cooling chamber; and a door having an ice making chamber and configured to open and close the cooling chamber, wherein the door includes a door outer plate, a door inner plate having the ice making chamber therein and disposed in the door outer plate to be spaced apart therefrom, and a connection duct part provided with passage forming members configured to connect the ice making chamber to the lateral wall passages to configure a cold air passage, and insulation portions formed around the passage forming members by a foaming operation.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator having an ice making chamber, the refrigerator comprising: a main body having at least one cooling chamber formed therein and lateral wall passages formed in a lateral wall of the at least one cooling chamber; a door rotatably coupled to the main body so as to open and close the at least one cooling chamber, the door comprising: an outer plate that defines an exterior side of the door; and an inner plate coupled to the outer plate, the inner plate defining an interior side of the door; an ice making chamber provided on the interior side of the door, the ice making chamber being installed on an inner surface of the door such that a gap having a predetermined length is formed between a lateral wall of the ice making chamber and a lateral wall of the inner plate adjacent to the lateral wall passages a connection duct that connects the ice making chamber to the lateral wall passages, wherein the connection duct extends through the gap formed between the lateral wall of the ice making chamber and the lateral wall of the inner plate, the connection duct comprising a passage forming member having a predetermined length corresponding to the predetermined length of the gap such that the passage forming member extends through the gap and has a first end engaged within an opening in the lateral wall of the ice making chamber and a second end engaged within an opening in the inner plate such that the passage forming member is contained within the gap formed between the lateral wall of the ice making chamber and the lateral wall of the inner plate adjacent to the lateral wall passages; and defines an air passage between the first and second ends thereof; and a foaming material filled in a space between the inner and outer plates of the door and directly surrounding the passage forming member, securing the connection duct in place within the space formed between the inner and outer plates of the door and insulating the passage forming member, wherein the passage forming member is made of a synthetic resin material, a rigidity of the passage forming member being greater than that of the foaming material, wherein the passage forming member comprises first and second partial passage forming members arranged vertically and immediately adjacent to each other, and coupled so as to define at least one air passage therebetween, and wherein the lateral wall of the inner plate comprises a coupling portion extending along the circumference of the opening, the second end of the passage forming member comprises a plurality of protrusions and protrusion accommodating portions, and the coupling portion of the inner plate comprises a plurality of through holes corresponding to the plurality of protrusions and protrusion accommodating portions formed at the second end of the passage forming member.

2. The refrigerator of claim 1, wherein the passage forming member is made of an acrylonitrile butadiene styrene (ABS) resin.

3. The refrigerator of claim 1, wherein the lateral wall of the inner plate of the door is positioned at a side of the door that is rotatably coupled to the main body.

4. The refrigerator of claim 1, wherein the connection duct further comprises a coupling portion provided at the second end of the passage forming member and partially exposed to an exterior of the door.

5. The refrigerator of claim 4, further comprising a gasket coupled to the coupling portion of the connection duct.

6. The refrigerator of claim 5, wherein one of two contact surfaces between the coupling portion of the connection duct and the gasket is provided with protrusions, and the other of the two contact surfaces is provided with protrusion accommodating portions in which the protrusions are received.

7. The refrigerator of claim 6, wherein both of the two contact surfaces between the coupling portion of the connection duct and the gasket are provided with the protrusions and the protrusion accommodating portions that are configured to be engaged so as to couple the gasket and the coupling portion of the connection duct.

8. The refrigerator of claim 1, further comprising:

a gasket provided at the lateral wall of the inner plate of the door, at a position corresponding to the second end of the passage forming member; and a coupling member positioned at an outside of the gasket and configured to fix the gasket in place relative to the connection duct.

9. The refrigerator of claim 8, wherein the coupling member comprises protrusions configured to extend through a portion of the gasket and into the passage forming member.

10. The refrigerator of claim 9, wherein the protrusions of the coupling member are each configured as a hook.

11. The refrigerator of claim 1, wherein the passage forming member comprises a first air passage that guides air from a first of the lateral wall passages to a first opening in the ice making chamber, and a second air passage that guides air from a second opening in the ice making chamber to a second of the lateral wall passages.

12. The refrigerator of claim 1, wherein the interior side of the door comprises a recess in which the ice making chamber is received such that a lateral wall of the recess faces a corresponding lateral wall of the ice making chamber, with the connection duct positioned therebetween so as to provide for communication between the lateral wall passages and the ice making chamber.

* * * * *